US006073548A

United States Patent [19]

Kayser et al.

[11] Patent Number: 6,073,548

[45] Date of Patent: Jun. 13, 2000

[54] ROLL MACHINE, ROLL, AND PROCESS OF FORMING ROLL MACHINE

[75] Inventors: Franz Kayser, Geldern; Rolf van Haag, Kerken, both of Germany

[73] Assignee: Voith Sulzer Finishing GmbH, Krefeld, Germany

[21] Appl. No.: 09/038,112

[22] Filed: Mar. 11, 1998

[30] Foreign Application Priority Data

Mar. 14, 1997 [DE] Germany ..... 197 10 573

[51] Int. Cl.[7] ..... B30B 3/04; D21G 1/02

[52] U.S. Cl. ..... 100/35; 100/155 R; 100/176; 492/7; 492/20; 492/56; 492/59

[58] Field of Search ..... 100/35, 155 R, 100/176; 492/7, 20, 48, 56, 59

[56] References Cited

U.S. PATENT DOCUMENTS

| | | | |
|---|---|---|---|
| 4,256,034 | 3/1981 | Kusters et al. | 100/176 |
| 4,823,450 | 4/1989 | Ramisch et al. | 492/7 |
| 5,023,985 | 6/1991 | Salo et al. | 492/59 |
| 5,655,444 | 8/1997 | Kayser et al. . | |
| 5,769,771 | 6/1998 | Van Haag . | |
| 5,836,860 | 11/1998 | Watanabe et al. | 492/56 |

FOREIGN PATENT DOCUMENTS

| | | |
|---|---|---|
| 2438706 | 5/1980 | France . |
| 19506301 | 8/1996 | Germany . |
| 19511153 | 10/1996 | Germany . |
| 1-246464 | 10/1989 | Japan . |
| 4-300385 | 10/1992 | Japan . |
| 5-54599 | 7/1993 | Japan . |
| 5-195496 | 8/1993 | Japan . |
| 6-173190 | 6/1994 | Japan . |
| 8-269886 | 10/1996 | Japan . |
| 8-269887 | 10/1996 | Japan . |
| 9-20993 | 1/1997 | Japan . |
| 9-256292 | 9/1997 | Japan . |
| 10-96186 | 4/1998 | Japan . |
| 1796730 | 2/1993 | U.S.S.R. . |
| 1011114 | 11/1965 | United Kingdom . |

OTHER PUBLICATIONS

Eidlin I. Y. Bumagodelateinye I Otdelochnye Mashiny (Paper–making and finishing machines) M. Lasnaya promyshiennost (Wood Industry), (1970). pp. 50–51.

Patent Abstracts of Japan of JP Patent No. 10–96186.

Patent Abstracts of Japan, vol. of JP Patent No. 9–20993.

Patent Abstracts of Japan, vol. of JP Patent No. 6–173190.

Patent Abstracts of Japan, vol. of JP Patent No. 4–300385.

Patent Abstracts of Japan, vol. of JP Patent No. 1–246464.

*Primary Examiner*—Stephen F. Gerrity

*Attorney, Agent, or Firm*—Greenblum & Bernstein, P.L.C.

[57] ABSTRACT

Roll machine and process for forming a roll machine. The roll machine includes a roll having a roll body and an elastic layer located on a periphery of the roll body, and a mating roll. At least one roll nip is formed between the roll and the mating roll, and the elastic layer has a radial thickness less than approximately 8 mm. The process includes covering the roll body with an elastic layer having a radial thickness less than approximately 8 mm and pressing the roll and the mating roll together to form a press nip.

27 Claims, 3 Drawing Sheets

ROLL MACHINE, ROLL, AND PROCESS OF FORMING ROLL MACHINE

CROSS REFERENCE TO RELATED APPLICATIONS

The present application claims priority under 35 U.S.C. § 119 of German Patent Application No. 197 10 573.4, filed Mar. 14, 1997, the disclosure of which is express incorporated by reference herein in its entirety.

BACKGROUND OF THE INVENTION

1. Scope of the Invention

The present invention relates to a roll machine, e.g.,. a calender, having at least one nip or roll opening formed between a roll and a mating roll, The roll includes a roll body having an elastic layer on its periphery.

2. Discussion of Background of the Invention

Calenders similar in general to the type described above are generally known, e.g., in paper making to compress a web made of base paper produced by a paper machine. These devices are utilized to improve surface quality of the paper web.

German Patent Application no. DE 195 06301 A1 shows a calender with both a "hard" and a "sofa" roll. The soft roll includes a two-layer covering made of synthetic material having an overall thickness of approximately 13 mm. The inner layer has a greater elasticity and less hardness than the outer layer.

Calenders of this type may be utilized to form super calenders, i.e. in which a number of rolls are positioned on top of each other to form a correspondingly large number of nips or roll openings. The rolls, which are generally characterized as "soft rolls", consist of multiple stacks of paper or cotton sheets mounted on an axis and pressed together under high pressure.

Recently, the "Janus-Concept" in rolls has been disclosed, in which the "soft rolls" are provided coverings made of synthetic material. In this manner, the roll body can either be formed by a roll jacket, when using a deflection-guided roll, or by a massive core.

The above-discussed calenders can also be used to form "soft calenders." In this case, generally only two to three rolls work against one another, For soft calenders, coverings made of synthetic materials are used almost exclusively as roll coating. The thicknesses of these coatings are greater than 1 cm. Because it is generally desirably to have added thickness in the roll coating as an allowance for truing the roll, the roll coatings are initially approximately 12.5 mm thick. Over time, the roll is generally trued so that the thickness is approximately 8.5 mm. So that these roll coverings can withstand the compressive strains in the nips, the synthetic material of the coverings are reinforced with fibers or other fillers. These reinforcing materials increase the elasticity modulus and form a certain, natural limit for attainable surface smoothness of the rolls.

Up to now, it has been assumed that when using a soft roll, the nip length, i.e. in the run direction of the web, extends during operation, because the pressing of lie mating roll against the elastic roll coating causes a flattening out or indenting of the elastic roll coating. With the greater nip length, it has been assumed that the compressive strain sinks with a constant line load. For example, when treating a material web in a "soft" roll opening formed by a soft roll and a hard mating roll a different outcome is achieved than when using a "hard" roll opening formed by two hard rolls working against each other. Thus, it is presumed that with an approximately linear roll contact and, therefore, a very narrow nip length, correspondingly high compressive strains are formed in the nip.

Further, using a nip formed with a soft roll has the advantage that, during treatment, the material web is protected. For example, during glazing of a paper web, developments such as an increased black glazing in unlined, uncoated papers, or an increased greasiness in lined papers can be avoided. However, the side of the paper web lying adjacent the soft roll is in many cases somewhat impaired, e.g., smoothness is decreased.

SUMMARY OF THE INVENTION

The present invention provides an improved surface quality during treatment in the roll machine. Further, the present invention provides a roll machine of tide type generally described above that includes an elastic layer that, in the radial direction, is very thin.

Thus, the present invention moves away from the above-noted arrangement in which the nip is lengthened during operation. The layer, in accordance with the present invention, is so thin that substantially only the upper surface is elastic, and deformation of the roll geometry, e.g., a flattening-out or indenting, practically does not occur.

The present invention was brought about by the following surprising discovery; In one experiment, a roll jacket of elastic synthetic material was fitted with a 120 $\mu$m thick hard chrome layer. The hard chrome layer was, as is possible with chrome, very smooth. With this arrangement, It was expected that the smoothness of the hard chrome layer would be "impressed" into paper web, i.e., to correspondingly increase smoothness on the side of the paper web adjacent this soft roll. While this arrangement achieved the expected increase in smoothness on the side of the web adjacent the soft roll, the glazing result was unexpected. In this regard, the phenomena that was heretofore only known from calenders formed by two hard rolls, i.e., increased black glazing of unlined, uncoated papers and increased mottling (greasiness) in lined papers, unexpectedly occurred. These results, which have been traced to crushing the fibers in the calender, especially protruding fibers, really shouldn't have happened. That is, the elastic roll was still generally soft enough, even though the 120 $\mu$m thick chrome layer does not provide the necessary stiffness. While other, and fewer, compressive tensions should have appeared in a hard roll opening; this was obviously not the case. Accordingly, this arrangement was abandoned in favor of another method.

The next arrangement reduced the thickness of the elastic layer on the upper surface of the roll. Astoundingly, superb glazing results appeared again with the treatment of the paper web, even though, in accordance with the prior methods of observation, what should have occurred with the increase of the pressure tensions in the nip, caused by the decrease in the elastic layer's thickness, occurred in the chrome layer. However, this was not the case. Good smoothness values and a corresponding sealing resulted, without an increased black glazing or increased greasiness. The roll coatings previously used were considered "thin" in contrast to the paper rolls that had a truing reserve in the magnitude of several 10 cm. Even with these "thin" roll coverings of the prior art, lengthening of the nip was presumed. However, no such presumption is applicable with the "very thin" elastic layer in accordance with the present invention, e.g., which attain the desired results with layer thicknesses clearly under approximately 8 mm.

Due to the elastic layer in the local region, the soft roll preferably demonstrates a surface elasticity. However, with respect to the elasticity, the layer demonstrates practically the same behavior as the roll body in the macroscopic region. The layer chosen is thus so thin that locally protruding fibers of the paper web can be pushed into the layer without crushing or damaging of the fibers. Thus, increased black glazing or an increased mottling (greasiness) is substantially avoided. Further, because the layer is so thin, during operation, practically no other surface form of the roll occurs. This is substantially the same as when two hard rolls are utilized. Thus, the previously assumed flattening-out of the elastic or soft roll in the nip region does not occur. The nip length, i.e., without paper, substantially corresponds to the length of a hard roll nip formed between two hard rolls. Thus, in effect, the arrangement provides a calender with two hard rolls in which one of the surfaces is elastic.

The roll body is preferably made of, e.g., steel or cast iron. The roll body can be, e.g., either a roll shell, if a deflection-guided roll is used, or it can also be a massive steel or cast iron core. In both cases, the roll body is rigid enough to summon and absorb the necessary compressive forces without resulting in a deformation that is worth mentioning. Thus, the desired proportions arise in this manner.

The thickness of the elastic layer preferably amounts to, e.g., approximately 4 mm or less, and in particular approximately 2.3 mm or less. With these thin layers, it is astounding, and surprising, that very good glazing results are attained. Further, these results are even better than that obtained with known roll machines, i.e., the arrangement provides good gloss and smoothness values while also substantially avoiding black glazing and mottling (greasiness).

It is advantageous if the layer is formed from a material that demonstrates a modulus of elasticity of approximately 4,000 N/mm$^2$ or less. Finders the "softer" the layer material is, i.e., the better its elasticity, the smoother the surface obtained and the lesser the local resistance of the layer is on the surface of the roll against the material web. Because the layer is thin enough, it is supported to a sufficient extent by the roll body. In this manner, the previously assumed deformations of the soft roll are not observed.

The thickness of the layer is preferably selected such that, during operation, the roll experiences a same distribution of compressive strain as in prior art machines having a same line load, a same roll nip geometry, and a fiber reinforced conventional layer with an elasticity modulus of approximately 6,000 N/mm$^2$ or more. The layer thickness can thus be changed together with the elasticity modulus of the material. For example, the lower the elasticity modulus is, the thinner the layer becomes. With a thinner layer, then, the influence of the elasticity of the layer material on the roll nip geometry is less significant. Thus, the desired distribution of compressive strain may be obtained.

The thickness of the layer is preferably made smaller than a distance of a shearing strain peak from an outer surface of the layer. Thus, the shearing strain peak, which is located within the elastic roll covering in conventional arrangements, is located in the roll body, i.e., radially inward. In this manner, tie strains on the layer material forming the elastic layer are reduced. Further, as a rule, the roll body is ready, and able, to absorb the shearing strain peak without greater difficulties. In this manner, the strain on the layer is kept to a minimum and the durability of the roll is increased.

With a line load of approximately 200 N/mm, die nip length calculated with the web, preferably has a value greater than the thickness of the layer by a factor of at least approximately 3.5. However, because the general calculation methods are only valid when the coating thickness at least approximately corresponds with the nip length, the general calculation methods cannot be utilized with the present invention. A numerical process is available, e.g., with the aid of the finite-element-method, to establish the size. In this manner, it can be determined that the coating thickness is small enough to obtain the desired effects, The layer is preferably formed from a synthetic material that is not reinforced. A synthetic material of this kind, i.e., without reinforcing fibers or reinforcing fillers, can generally only be stressed to a small extent. However, when the layer thickness is small enough, the desired resiliency can be obtained even with non-reinforced synthetic materials. The great advantage of a non-reinforced synthetic material is that its surface can be very smoothly shaped. That is, up to now, the degree of smoothness was limited because die fibers or fillers serving to reinforce affected the surface roughness. Further, the surface roughness generally varies with the order of the size of the fibers or fillers. Thus, without these additional materials, surface roughness or smoothness can be controlled based exclusively on the synthetic materials utilized.

It is preferable that the thickness of the layer be limited to a value less than approximately 90% of the value forming a stress ceiling for compressive forces prevailing in the roll nip. These compressive forces prevailing in the roll nip are either known or can be calculated. Because is either peels off the roll or is damaged during operation, the synthetic material that is not reinforced cannot be used once it reaches a certain thickness. If necessary, the precise limit may be determined through experiments. Thus, if a certain distance from the limit is maintained and the synthetic material layer is made thinner, then, one has a measure for how thick the synthetic material may be, and has a certain assurance that small disturbances will not result in damage to the synthetic material.

It is advantageous if the layer is composed of pure epoxy resin. For example, epoxy resin, in an unreinforced state, has a relatively low modulus of elasticity, and it can be polished very smooth to obtain a high increase in the smoothness of the treated material web.

The layer is preferably composed of a spray able synthetic material and is sprayed onto the roll body. By spraying, a relatively good bonding of the synthetic material with the roll body results. Further, the relatively thin layers can be obtained to produce a roll covering, which locally, i.e., in the microscopic region, has the necessary elasticity, but globally, i.e., in the macroscopic region, has no mentionable flexibility that can lead to a deformation of the roll.

In another advantageous embodiment, the layer may be formed as a lacquer layer. In this manner, a certain elasticity is provided only on the surface of die roll. Further, lacquer layers are generally quite thin, so that the main stain may be actually absorbed by the roll core. The thinner die elastic layer is, the less it is pressed during operation, and the less heat develops. Thus, the temperature created by the pressing can be better controlled so that the temperature in the roll nip can be better adjusted. The coating, i.e., the elastic layer, may be stressed to a lesser degree by higher temperatures. In this case, the calender may be considered a thickening calender, i.e., a roll machine with two hard rolls forming the nip, and in which one of the two hard rolls is lacquered.

In an alternative embodiment, the layer may be formed by a shrink tube. A shrink tube of his kind may be pushed over the roll body and then, using heat, shrunk down onto the roll body. Thus, the elastic layer on the surface of the roll is created relatively quickly and at the same time is reliably connected to the roll body. It is also possible to replace the elastic layer without a problem. To replace the layer, the shrinkage tube is opened by slitting the jacket and then removing it. The roll body is then ready for a new shrinkage tube. If appropriate, the new tube may be trued and smoothly sanded.

The surface of the layer preferably is sanded to a roughness value of approximately 0.1 $\mu$m or less. Smooth surfaces of this kind can be obtained with thin layers. Since the roughness of the roll is "impressed" in the material web, the smoother the surface is, the smoother the processed material web becomes. With the use of epoxy resin, a roughness of approximately 0.05 $\mu$m may be obtained.

Accordingly, the present invention is directed to a roll machine that includes a roll having a roll body and an elastic layer located on a periphery of the roll body, and a mating roll. At least one roll nip is formed between the roll and the mating roll, and the elastic layer has a radial thickness less than approximately 8 mm, In accordance with another feature of the present invention, the elastic layer provides a surface elasticity in a local region, and provides a rigidity substantially similar to the roll body in a global region.

In accordance with another feature of the present invention, the roll body is composed of one of steel and cast iron.

In accordance with another feature of the present invention, the radial thickness of die elastic layer is approximately 4 mm or less.

In accordance with still another feature of the present invention, the radial thickness of the elastic layer is approximately 2.3 mm or less.

In accordance with a further feature of the present invention, the elastic layer includes a modulus of elasticity of approximately 4,000 N/mm$^2$ or less. Still further, the radial thickness of the elastic layer is selected such that a compressive stress distribution occurring in the roll during operation under an operating line load exerted on an operating roll nip geometry is substantially the same as a test compressive stress distribution in a test roll under a test line loads substantially similar to the operating line load, exerted on a test roll nip geometry, substantially similar to the operating roll nip geometry, and the test roll further including a fiber-reinforced material layer having a modulus of elasticity of approximately 6,000 N/mm$^2$ or more.

In accordance with another feature of the present invention the radial thickness of the elastic layer is less than a distance of a shearing stress peak from an outer surface of the elastic layer.

In accordance with still another feature of the present invention, the roll machine also includes a device for exerting a lime load of 200 N/mm at the roll nip, A length of the roll nip, relative to a web travel direction, while pressing the web, is greater than the radial thickness of the elastic layer by a factor of at least approximately 3.5.

In accordance with a further feature of the present invention, the elastic layer is composed of a non-reinforced synthetic material. Further, the radial thickness of the elastic layer is selected to be less than or equal to a value less than approximately 90% of a value forming a stress limit in compressive strains prevailing in the roll nip.

In accordance with another feature of the present invention, the elastic layer is composed of pure epoxy resin.

In accordance with a still further feature of the present invention, the elastic layer is composed of a spray able synthetic material that is sprayed onto the roll body.

In accordance with another feature of the present invention, the elastic layer is composed of a lacquer layer.

In accordance with another feature of the present invention, the elastic layer includes a shrinkage tube.

In accordance with still another feature of the present invention, a surface of the elastic layer is sandable to a roughness value of approximately 0.1 $\mu$m or less.

The present invention is directed to a roll for a roll machine that includes a roll body and an elastic layer located on a periphery of the roll body. The elastic layer has a radial thickness of less than 8 mm.

The present invention is directed to a process for forming a roll machine. The roll machine includes a roll having a roll body and a mating roll, and the process includes covering the roll body with an elastic layer having a radial thickness less than approximately 8 mm and pressing the roll and the mating roll together to form a press nip.

In accordance with another feature of the present invention, the covering of the roll body includes spraying a synthetic material coating on the roll body.

In accordance with another feature of the present invention, the covering of the roll body includes applying a shrink tube over the roll body and applying heat to the shrink tube. In this manner, the shrink tube is reduced in size to fit the roll body. Further, the process includes smoothing the surface of the coating to a roughness value of approximately 0.1 $\mu$m or less.

In accordance with still another feature of the present invention, the covering of the roll body includes applying a lacquer layer of an epoxy resin material.

In accordance with a further feature of the present invention, the process includes forming the elastic layer from a non-reinforced synthetic material.

In accordance with a still further feature of the present invention, the process includes forming the elastic layer from an epoxy resin material.

In accordance with still another feature of the present invention, the process includes forming the roll body from one of steel and cast iron.

In accordance with another feature of die present invention, the process includes selecting the radial thickness of the elastic layer such that a compressive stress distribution occurring in the roll during operation under an operating line load exerted on an operating roll nip geometry is substantially the same as a test compressive stress distribution in a test roll under a test line load, substantially similar to the operating line load, exerted on a test roll nip geometry, substantially similar to the operating roll nip geometry, and the test roll further including a fiber-reinforced material layer having a modulus of elasticity of approximately 6,000 N/mm$^2$ or more.

In accordance with still another feature of the present invention, the process includes selecting a radial thickness of the elastic layer to be less than a distance of a shearing stress from an outer surface of the elastic layer.

In accordance with yet another feature of the present invention, the process includes selecting a radial thickness of the elastic layer to be less than or equal to a value less than approximately 90% of a value that forms a stress limit in compressive strains prevailing in the roll nip.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of preferred embodiments of the present invention, in which like reference numerals represent similar parts throughout the several views of the drawings, and wherein.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art know the several forms of the present invention may be embodied in practice.

Figure 1:
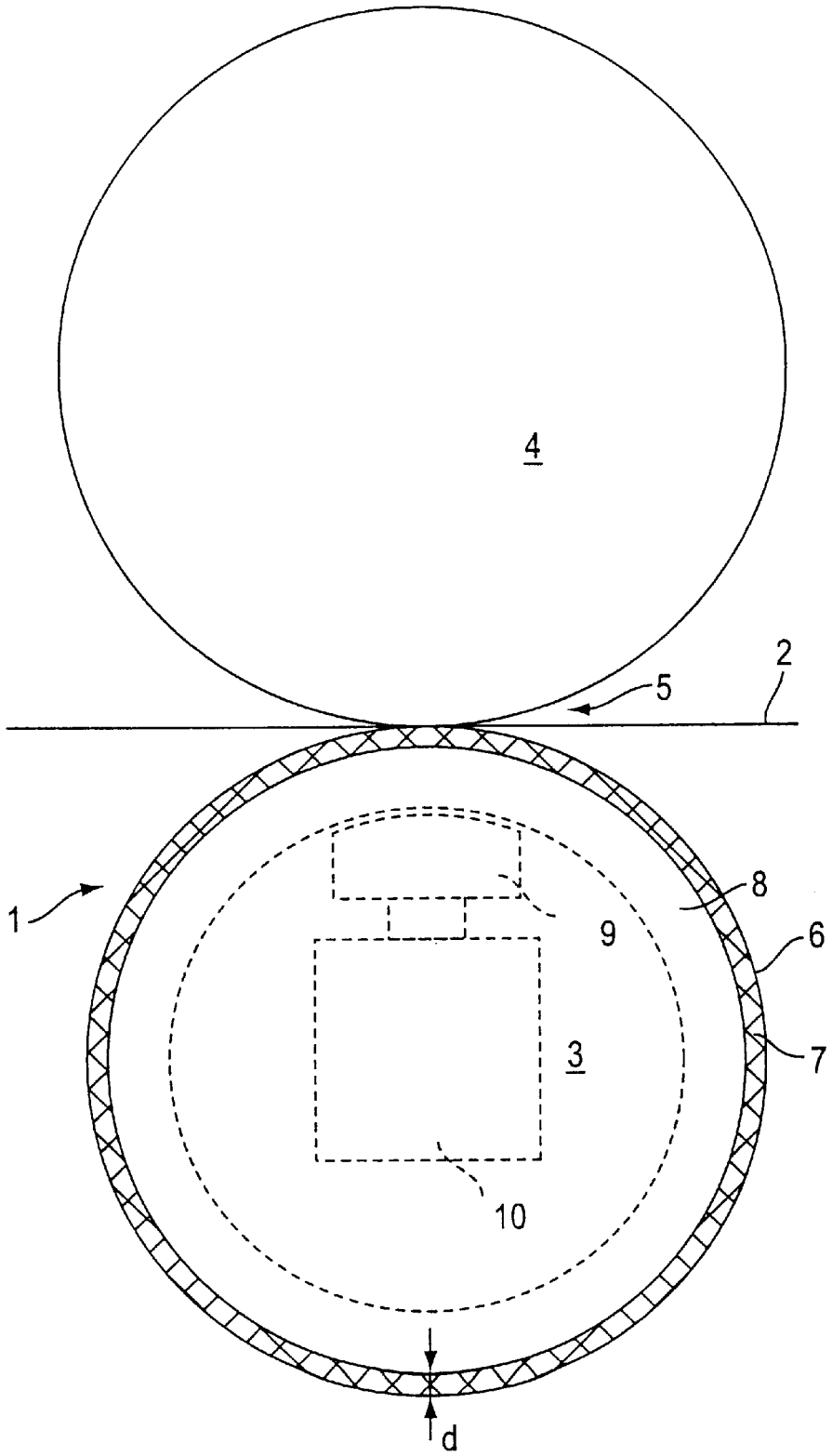
FIG. 1 illustrates a schematic view of a calender with two rolls.

Schematically depicted in FIG. 1 is a calender 1 utilized to treat a material web 2, e.g., paper, Calender 1 includes two rolls 3 and 4 that form a roll nip (opening) 5 between them. During operation, rolls 3 and 4 are pressed together with devices that are generally known, and therefore, not depicted here in any detail here. Further, material web 2 is treated under the pressure exerted in roll nip 5. This pressure treatment can lead to a compression of material web 2, but is also used to improve surface quality of material web 2.

Because roll nip 5 is formed between an elastic surface 6 of roll 3 and roll 4, roll nip 5 may be referred to as a "soft" roll nip. Because roll 3 has a very thin layer 7 of an elastic material formed on its periphery, surface 6 is elastic, Thin layer 7 may be deposited on a roll body 8 of roll 3. Roll body 8 may be a massive roll core made of steel or cast iron, e.g., chilled iron or gray iron. Alternatively, as depicted with the dashed-line, roll body 8 may formed as a roll jacket of a deflection adjustment roll. In this event, roll body 8 may be supported by pressure elements 9 arranged on a carrier 10. Pressure elements 9 may be utilized to impart pressure against the inside surface of roll body 8 against roll 4.

Roll 4 is a hard roll, i.e., a roll that is of an inflexible design, and may be composed of, e.g., steel or cast iron. To improve smoothness of the surface of roll 4, a hard chrome layer or another hard and smooth layer can be deposited on roll 4 in a known manner.

Elastic layer 7 on soft roll 3 is depicted in FIG. 1 in an exaggerated manner to facilitate discussion and understanding of the present invention. With conventional soft rolls, the thickness of the outer layer is generally approximately 12.5 mm. The surface would then be trued to thicknesses of about 8 mm if damages or markings occurred during operation, In accordance with the present invention, the thickness d of elastic layer 7 of roll 3 is considerably less than the conventional designs. In other words, layer 7 is a very thin layer having a thickness d of approximately 1.75 mm. Further, the modulus of elasticity for layer 7 is approximately 3,500 N/mm$^2$. Still further, layer 7 may be composed of an epoxy resin that may be sprayed onto the outer surface of roll body 8. Thus, layer 7 applied in this manner is free of reinforcing fibers or other reinforcing fillers. Thus, surface 6 of layer 7 may be sanded to a very smooth finish. In this manner, the side of material web 2 lying adjacent to soft roll 3 obtains exceptional gloss and smoothness values. Further, because the layer does not include reinforcing fibers or fillers, a diminished modulus of elasticity can be used as compared to that of conventional roll coverings, which are generally in the order of 6,000 to 8,000 N/mm$^2$, and particularly 6,900 N/mm$^2$.

Since thickness d of layer 7 is very small, surface 6 of roll 3 is barely deformable, at least in the macroscopic (global) region, Even during operation, the shape of the roll is determined by the shape of roll body 8. Thus, with the present invention, the known larger flattening-out or indenting of the soft rolls during operation can be substantially dismissed with relative certainly.

Despite the very thin layer 7, surface 6 of soft roll 3 is elastic enough to allow deformation in the microscopic (local) region. For example, in contrast to the arrangement of two hard rolls, if fibers protrude from the surface of paper web 2, the local elasticity of surface 6 flattens the protruding fibers in the roll nip 5 without crushing them. Thus, the present invention substantially avoids the known developments of the black glossing or mottling (greasiness) of web 2 as it passes through roll nip 5.

As noted above, thickness d of layer 7 may be very thin. In fact, it is sufficient to deposit the layer material, e.g., an epoxy resin, like a lacquer such that thickness d lies in the order of approximately a few tenths or even approximately a few hundredths of a millimeter. Alternatively, layer 7 may be formed with a shrink tube having an interior diameter proportioned to the external diameter of roll body 8. In this manner, the shrink tube may be pushed onto unlayered roll body 8. When heat is applied to the shrink tube, e.g., hot air, the tube shrinks and positions itself evenly over the surface of roll body 8. Then it is only necessary to smooth surface 6.

Due to the thin thickness of layer 7, if surface 6 has damages or markings, the truing reserves are exhausted. However, this is not critical. For example, in the case of a shrinkage tube with damage or markings, the old shrinkage tube may be cut open and removed and a new one is put on. In the case of a lacquered surface with damages and markings, the roll can be lacquered anew. Both replacements methods proceed relatively quickly. Further, even when the epoxy resin or another synthetic material is sprayed on very thickly, the desired surface quality may be achieved relatively quickly by a renewed spraying.

In an advantageous embodiment of the present invention, thickness d of layer 7 is approximately 4 mm. It is also generally applicable that the modulus of elasticity must rise with increasing thickness d, so that layer 7 can withstand the compressive strains prevailing in roll nip 5.

Calculations were performed in order to compare soft roll 3 having very thin layer 7 to a conventional roll having a thicker layer. Since thickness d of layer 7 is markedly less significant than the contact length of material web 2 with rolls 3 and 4, the known calculations of the prior art, e.g., Hertz, cannot be considered accurate, and, thus, are not utilized in accordance with the present invention. However, with discrete procedures, e.g., in accordance with the method of finite elements, the stress distributions can be calculated in the rolls. In the present case, the calculations were performed as described in the dissertation by Rolf van Haag "On the Compressive Stress Distribution and the Paper Compression in the Roll Opening of a Calender", Darmstadt, 1993.

Figures 2A, 2B:
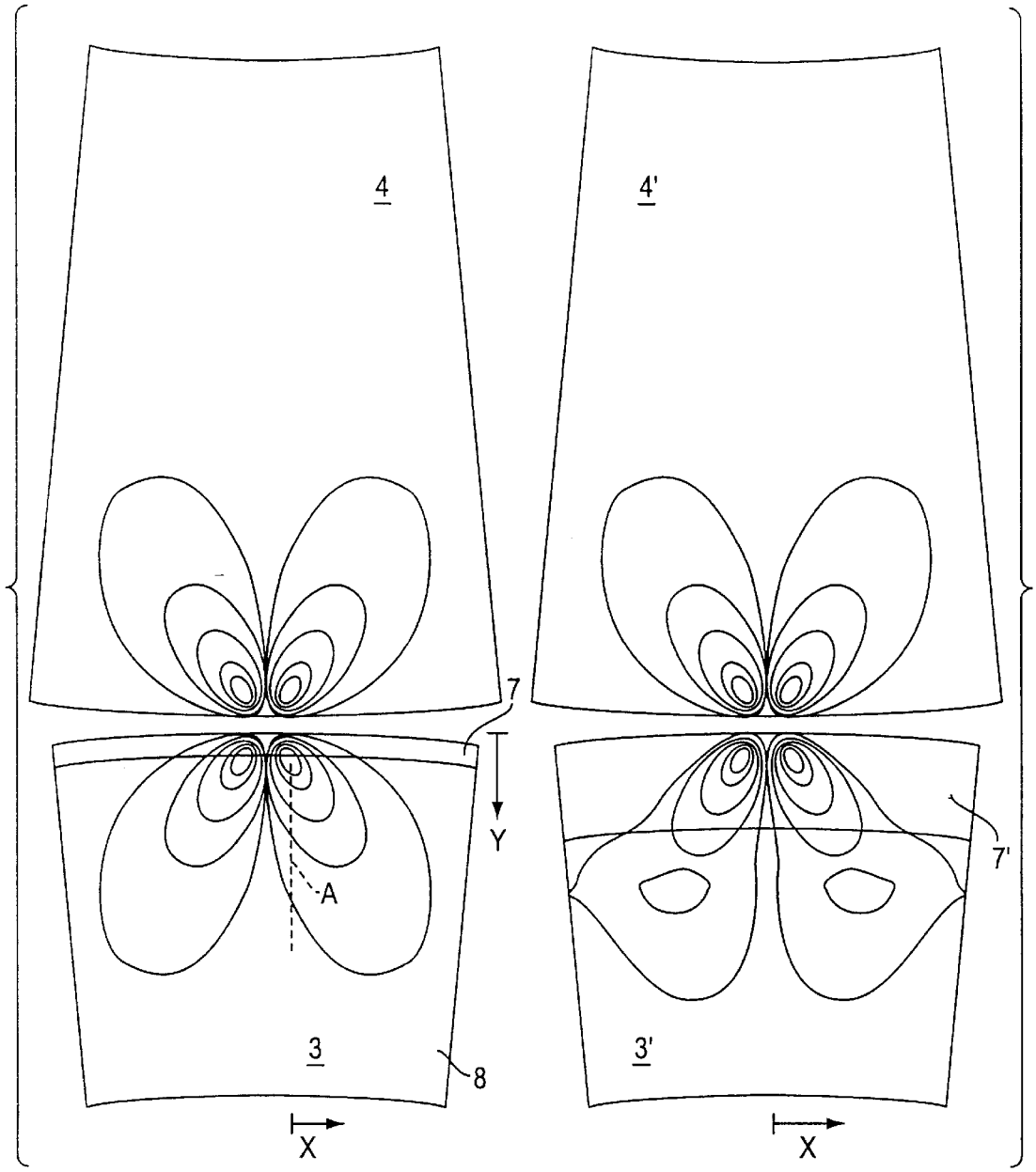
FIGS. 2*a* and 2*b* illustrate isolines of a shearing strain to compare a very thin elastic layer to an elastic layer with conventional layer thickness.

FIGS. 2*a* and 2*b* show lines of shearing stresses associated in layer thicknesses 7 and 7' in accordance with the present invention and with the conventional design of the prior art, respectively. These calculations yield the following figures;

| | Present Invention | Conventionul Calender |
|---|---|---|
| Diameter of Hard Roll 4, 4' | 459 mm | 459 mm |
| Diameter of Soft Roll 3, 3' | 415 mm | 415 mm |
| Line load | 200 N/mm | 200 N/mm |
| Paper Thickness in the Inlet | 72 $\mu$m | 72 $\mu$m |
| Thickness of Layer 7, 7' | 1.75 mm | 12.5 mm |
| Modulus of Elastisity | 3,500 N/mm$^2$ | 6,900 N/mm$^2$ |

Figure 3:
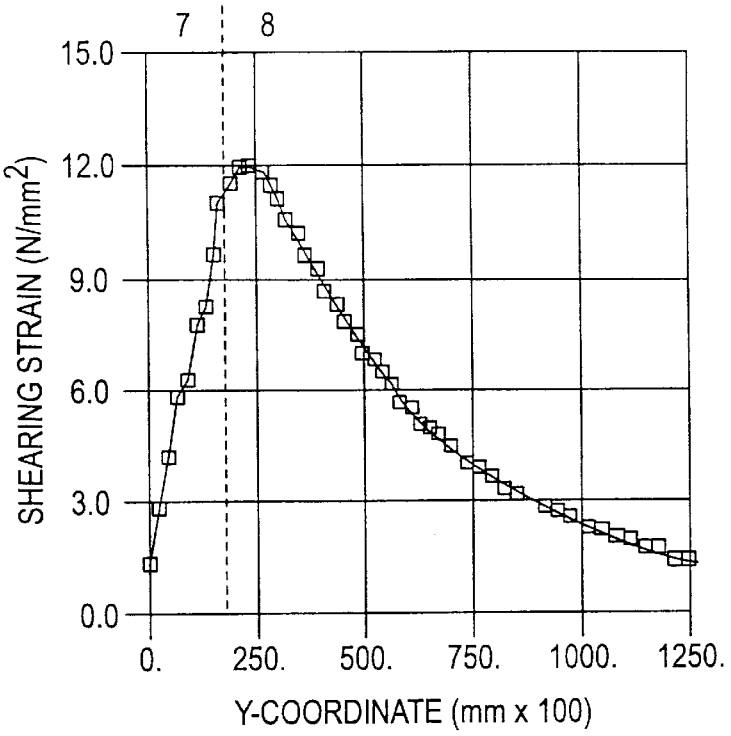
FIG. 3 illustrates the progress of the shearing strain substantially in a radial direction.

From the obtained results, the shearing stresses in both cases look similar, However, it further becomes obvious that, with the very thin layer 7 depicted in FIG. 2*a*, the shearing stress peak lies outside layer 7, and is moved into roll body 8. In contrast, the conventional case shows the shearing stress peak located in the middle of elastic layer 7'. The location of the shearing stress is more clearly depicted in FIG. 3 which shows a plot of the Y-coordinate, as depicted in FIGS. 2*a* and 2*b*, and the shearing strain. The shearing strain is illustrated in FIG. 2*a* as line A located in a substantially radial direction of soft roll 3. The dashed line in FIG. 3 shows the border between very thin layer 7 and roll body 8. As shown, the maximum shearing stress occurs at approximately 2.42 mm, and thickness d of layer 7 only amounts to approximately 1.75 mm. Thus, the maximum shearing stress is located within roll body 8. Because roll body 8 is formed of, e.g., steel or cast iron, it is therefore able to absorb the maximum shearing stress without a problem.

Figure 4:
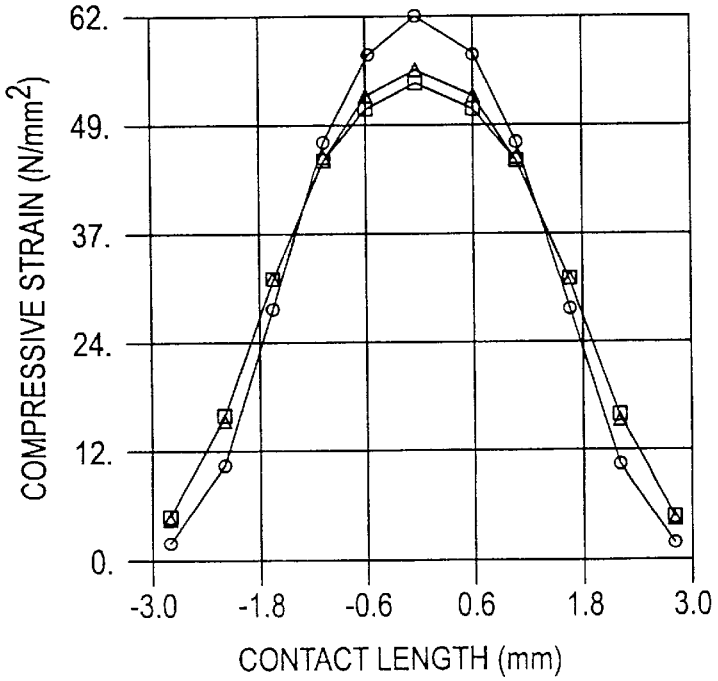
FIG. 4 illustrates comparison of calculated contact widths.

FIG. 4 illustrates a further comparison of the very thin layered roll of the present invention and the conventional roll having a thickness d of 12.5 mm.

The profile (plot) marked by squares depicts a compressive strain curve for a conventional coating having a thickness of 12.5 mm, a modulus of elasticity of 6,900 N/mm$^2$, and a line load of 200 N/mm. Using tie same coating except with a thickness of approximately 1.75 mm, the profile marked by the circles would result. Thus, as shown, the maximal compressive strain would increase from approximately 54 to approximately 62 N/mm$^2$. However, because in this region the stabilities of the coating are reached or exceeded, this type of coating is not desired.

The present invention utilizes resin as a coating because its modulus of elasticity is markedly less than the prior an coating, i.e., approximately 3,500 N/mm$^2$. Thus, use of resin as the coating provides favorable conditions, e.g., with respect to distribution of the shearing stresses. For example, as the profiled marked by triangles shows, the curves of the thick, harder coating (squares) and the thin, soft (resin) coating (triangles) are almost congruent.

Because the very thin resin coatings can be sanded much smoother than the conventional coatings, and because the resin coating develops less heat during pressing, which in some circumstances can be harmful to the coating, some clear advantages for glazing are achieved. In this regard, it is interesting that the nip lengths are the same in each case, and the influence of the paper web is apparent.

As discussed above, if a very thin coating is used, reinforcing fibers or reinforcing fillers are unnecessary in the coating. In addition to the advantage of achieving a very smooth surface 6 having a roughness of approximately 0.05 $\mu$m, the lack of reinforcing fibers or fillers enables the advantage that handling of the synthetic material during application to the roll body significantly simpler, Thus, materials are saved and finishing costs are thereby reduced. Further, while finishing costs are reduced, a marked improvement in quality during the glazing of paper and other material webs is achieved.

It is noted that the foregoing examples have been provided merely for the purpose of explanation and are in no way to be construed as limiting of the present invention. While the present invention has been described with reference to a preferred embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed:

1. A roll machine comprising:

a roll including a roll body and an elastic layer located on a periphery of the roll body;

a mating roll;

at least one roll nip formed between the roll and the mating roll;

the elastic layer having a radial thickness less than 8 mm, wherein a radial thickness of the elastic layer is selected such that a compressive stress distribution occurring in the roll during operation under an operating line load exerted on an operating roll nip geometry is substantially the same as a test compressive stress distribution in a test roll under a test line load, which is substantially similar to the operating line load, exerted on a test roll nip geometry, which is substantially similar to the operating roll nip geometry, wherein the test roll includes a fiber-reinforced material layer having a modulus of elasticity of 6,000 N/mm$^2$ or more.

2. A roll machine comprising:

a roll including a roll body and an elastic layer located on a periphery of the roll body;

a mating roll;

at least one roll nip formed between the roll and the mating roll;

the elastic layer having a radial thickness less than 8 mm, wherein a radial thickness of the elastic layer is less than a distance of a shearing stress peak from an outer surface of the elastic layer.

3. The roll machine in accordance with claim 2, the elastic layer providing a surface elasticity in a local region, and providing a rigidity substantially similar to the roll body in a global region.

4. The roll machine in accordance with claim 2, the roll body being composed of one of steel and cast iron.

5. The roll machine in accordance with claim 2, the elastic layer comprising a modulus of elasticity of 4,000 N/mm$^2$ or less.

6. The roll machine in accordance with claim 2, the elastic layer being composed of a sprayable synthetic material that is sprayed onto the roll body.

7. The roll machine in accordance with claim 2, a surface of the elastic layer is sandable to a roughness value of 0.1 $\mu$m or less.

8. The roll machine in accordance with claim 2, the elastic layer being directly mounted on the roll body.

9. The roll in accordance with claim 2, the elastic layer being in direct contact with the periphery of the roll body.

10. A roll machine comprising:

a roll including a roll body and an elastic layer located on a periphery of the roll body;

a mating roll;

at least one roll nip formed between the roll and the mating roll;

the elastic layer having a radial thickness less than 8 mm;

a device for exerting a line load of 200 N/mm at the roll nip; and a length of the roll nip, relative to a web travel direction, while pressing the web, is greater than the radial thickness of the elastic layer by a factor of at least 3.5.

11. The roll in accordance with claim 10, the elastic layer being directly located on the roll body.

12. The roll machine in accordance with claim 10, the elastic layer being in direct contact with the periphery of the roll body.

13. A roll machine comprising:

a roll including a rigid roll body and an elastic layer mounted on a periphery of the rigid roll body;

a mating roll;

at least one roll nip formed between the roll and the mating roll;

the elastic layer having a radial thickness less than 2.3 mm;

the elastic layer being composed of a non-reinforced synthetic material; and the radial thickness of the elastic layer is selected to be less than or equal to a value less than 90% of a value forming a stress limit in compressive strains prevailing in the roll nip.

14. A roll machine comprising:

a roll including a rigid roll body and an elastic layer mounted on a periphery of the rigid roll body;

a mating roll;

at least one roll nip formed between the roll and the mating roll;

the elastic layer having a radial thickness less than 2.3 mm; and the elastic layer being composed of pure epoxy resin.

15. A roll machine comprising:

a roll including a rigid roll body and an elastic layer mounted on a periphery of the rigid roll body;

a mating roll;

at least one roll nip formed between the roll and the mating roll;

the elastic layer having a radial thickness less than 2.3 mm; and the elastic layer is composed of a lacquer layer.

16. A process for forming a roll machine, the roll machine including a roll having a rigid roll body and a mating roll, the process comprising:

mounting an elastic layer having a radial thickness less than 2.3 mm onto a peripheral surface of the rigid roll body;

pressing the roll and the mating roll together to form a press nip; and the mounting of the elastic layer comprising applying a lacquer layer of an epoxy resin material over the roll body.

17. The process in accordance with claim 16, directly mounting the elastic layer onto the peripheral surface of the rigid roll body.

18. A process for forming a roll machine, the roll machine including a roll having a rigid roll body and a mating roll, the process comprising:

mounting an elastic layer having a radial thickness less than 2.3 mm onto a peripheral surface of the rigid roll body;

pressing the roll and the mating roll together to form a press nip; and forming the elastic layer from an epoxy resin material.

19. The process in accordance with claim 18, mounting the elastic layer in direct contact with the periphery of the rigid roll body.

20. A process for forming a roll machine, the roll machine including a roll having a roll body and a mating roll, the process comprising:

covering the roll body with an elastic layer having a radial thickness less than approximately 8 mm;

pressing the roll and the mating roll together to form a press nip, and selecting the radial thickness of the elastic layer such that a compressive stress distribution occurring in the roll during operation under an operating line load exerted on an operating roll nip geometry is substantially the same as a test compressive stress distribution in a test roll under a test line load, which is substantially similar to the operating line load, exerted on a test roll nip geometry, which is substantially similar to the operating roll nip geometry, wherein the test roll includes a fiber-reinforced material layer having a modulus of elasticity of 6,000 N/mm$^2$ or more.

21. A process for forming a roll machine, the roll machine including a roll having a roll body and a mating roll, the process comprising:

covering the roll body with an elastic layer having a radial thickness less than approximately 8 mm;

pressing the roll and the mating roll together to form a press nip; and selecting a radial thickness of the elastic layer to be less than a distance of a shearing stress from an outer surface of the elastic layer.

22. The process in accordance with claim 21, the covering of the roll body with an elastic layer comprising spraying a synthetic material coating on the roll body.

23. The process in accordance with claim 21, the covering of the roll body with an elastic layer comprising applying a shrink tube over the roll body;

applying heat to the shrink tube, whereby the shrink tube is reduced in size to fit the roll body.

24. The process in accordance with claim 23, further comprising:

smoothing the surface of the heat shrink tube to a roughness value of 0.1 $\mu$m or less.

25. The process in accordance with claim 21, further comprising:

forming the elastic layer from a non-reinforced synthetic material.

26. The process in accordance with claim 21, further comprising:

forming the roll body from one of steel and cast iron.

27. A process for forming a roll machine, the roll machine including a roll having a roll body and a mating roll, the process comprising:

covering the roll body with an elastic layer having a radial thickness less than approximately 8 mm;

pressing the roll and the mating roll together to form a press nip; and selecting a radial thickness of the elastic layer to be less than or equal to a value less than 90% of a value that forms a stress limit in compressive strains prevailing in the roll nip.

* * * * *